United States Patent [19]

Thalenfeld

[11] 4,436,209

[45] Mar. 13, 1984

[54] MERCHANDISE DISPLAY HOOK

[75] Inventor: David R. Thalenfeld, Beachurst, N.Y.

[73] Assignee: Trion Industries Inc., Wilkes-Barre, Pa.

[21] Appl. No.: 303,419

[22] Filed: Sep. 18, 1981

Related U.S. Application Data

[63] Continuation-in-part of Ser. No. 151,357, May 19, 1980, Pat. No. 4,351,440, Continuation-in-part of Ser. No. 918,483, Jun. 23, 1978, abandoned.

[51] Int. Cl.[3] ..... A47F 5/00

[52] U.S. Cl. ..... 211/57.1; 211/59.1; 248/220.4; 248/222.2

[58] Field of Search ..... 211/57.1, 59.1, 54.1; 248/220.2, 220.3, 220.4, 221.1, 221.2, 221.3, 222.2

[56] References Cited

U.S. PATENT DOCUMENTS

| | | | |
|---|---|---|---|
| D. 249,460 | 9/1978 | Bleed | D8/373 |
| 3,198,469 | 8/1965 | Callanan | 248/220.4 |
| 3,711,048 | 1/1973 | Thalenfeld | 248/221.1 X |
| 4,026,508 | 5/1977 | Ziegler | 211/59.1 X |
| 4,351,440 | 9/1982 | Thalenfeld | 211/57.1 |

FOREIGN PATENT DOCUMENTS

| | | | |
|---|---|---|---|
| 963877 | 3/1975 | Canada | 248/221.2 |
| 1483450 | 8/1977 | United Kingdom | 248/220.4 |

OTHER PUBLICATIONS

Trion Industries, Inc., Point of Purchase Catalog, p. 500, p. 7, "Back Plates", 400 Series.

*Primary Examiner*—Ramon S. Britts
*Assistant Examiner*—Robert W. Gibson, Jr.
*Attorney, Agent, or Firm*—Mandeville and Schweitzer

[57] ABSTRACT

The disclosure relates to a two-piece, pivoting base merchandise hook, for use on perforated panel board displays. A molded plastic base member, provided with panel engaging lugs, pivotally engages a short hinge bar, welded to an L-shaped merchandise support. The wire and hinge bar constitute a two-part, welded assembly, which may be mass produced on high speed wire forming equipment. The base member is a mass-produced, low-cost molding of an engineering plastic material. The base and wire members may be assembled when the hook is first installed. After initial assembly, the base is, for all practical purposes, captive with the wire.

10 Claims, 7 Drawing Figures

MERCHANDISE DISPLAY HOOK

This application is a continuation-in-part of my earlier application Ser. No. 151,357 filed May 19, 1980, now U.S. Pat. No. 4,351,440 which in turn is a continuation-in-part of my prior application Ser. No. 918,483 filed June 23, 1978, now abandoned.

BACKGROUND AND SUMMARY OF THE INVENTION

In the setting up of merchandise displays, using so-called peg board hooks mounted on perforated panel board, the ability to easily install and remove the merchandise display hooks, and the ability to maximize the utilization of the panel board space with merchandise displays are important considerations to the efficient merchandiser. The most primitive and inexpensive form of merchandise display hook consists of an elongated wire support, welded or otherwise secured to a base, having a pair of L-shaped mounted lugs. By tilting the hook upwardly, the lugs may be inserted into and/or removed from apertures in the panel board. However, the need for the hook to be tilted upwardly during installation and removal significantly reduces the efficiency of the display because of the need for providing clearance space above each hook.

The Thalenfeld U.S. Pat. No. 3,289,993 represented an important advance in the design of merchandise hooks in that a base member, provided with spaced, L-shaped mounting lugs, was mounted for pivoting movement with respect to an outwardly extending merchandise supporting wire. For installation and/or removal of that hook, was not necessary to tilt upwardly the entire hook, but only to pivot the base member. By enabling hooks to be inserted and removed without significant vertical clearance, not only was it possible to achieve greater utilization of the panel board space for merchandise displays, but perhaps equally important, the task initially setting up a display was greatly expedited. With respect to the latter aspect, during the initial set up of a display, it is frequently necessary to relocate hooks after a preliminary installation, in order to improve the appearance and/or space utilization of the panel. With the hook of the Thalenfeld U.S. Pat. No. 3,289,993, such operations were greatly enhanced, enabling significant labor savings to be realized.

Although the hook of the Thalenfeld U.S. Pat. No. 3,289,993 is a functionally superior hook, which has enjoyed enormous commercial success, it is necessarily somewhat higher in manufacturing cost than hooks of more simplified, functionally inferior design, so tht a demand has continued for merchandise hooks of lower cost construction.

One type of hook that has achieved a certain market share in competition with the functionally superior hook of the aforementioned Thalenfeld patent is the two-part, plastic base hook as represented in a general way in, for example, the Lucietto et al U.S. Pat. No. 3,452,954 and/or the Silver U.S. Pat. No. 3,897,926. These patents are generally representative of hooks which comprise a formed wired merchandise support and a separate, molded plastic base provided with L-shaped mounting lugs. Both the wire merchandise support and the plastic base may be mass-produced on a low-cost basis, aided in no small measure by the fact that the original manufacturer need not assemble the parts prior to the delivery to the customer. Installation of the hook by the customer includes on-site assembly of the wire and base components. Where high density space utilization is required, the base element alone can be first installed on the panel board and the wire support may then be assesmbled to the base. In order to remove the hook, the wire element is first disassembled from the base, and then the base is removed from the panel. If display density is not a factor (i.e. there is ample clearance space above the hook) the hook may simply be tipped up and removed in its assembled position, much the same the more primitive form of hook described above.

Although the two-part, plastic base hooks described in the prededing paragraph have achieved a reasonable market share, because of favorable manufacturing costs comparisons in relation to the hook of the Thalenfeld patent mentioned above, the two-part hooks remain functionally very inferior to the hook with the pivoting base. Not only is installation and removal substantially more complicated, but the merchandiser is frequently dealing with multiple parts, which results in reduced efficiencies.

In accordance with the present invention, a new and improved merchandise hook is provided which has essentially all the superior functional characteristics of the hook of the Thalenfeld U.S. Pat. No. 3,289,993, yet is fully price competitive with the more conventional, two-part plastic based hooks. More specifically, the hook of the present invention comprises a wire merchandise supporting element which is cooperatively joined with a molded plastic base. Unlike the conventional two-part plastic base hooks, however, the hook of the invention, after initial assembly of the wire element to the plastic base, becomes a unitiary assembly with the base having a pivotal relationship to the hook to accommodate facile installation and/or removal of the hook without the cumbersome and time-consuming manipulations required of the more conventional two-piece plastic base constructions.

Importantly, even though the hook of the present invention eventually results in a "permanently" assembled hook and base, the initial assembly need not be made until installation at the customers display location. As a result, assembly of the base and hook is not an element of manufacturing costs.

One of the more specific, advantageous features of the new hook resides in the design of the base and hook members such that the initial, semi-permanent assembly of base to hook may be carried out with one hand, using the leverage obtained through upward tilting of the base member with respect to the wire merchandise support element which is held confined by the front surface of the panel board. The entire operation is swift and sure and enables the parts to be snapped together in a rugged and reliable pivotally associated relationship, with a minimum of strength and/or dexterity required on the part of the operator.

An additional feature of the invention resides in the design of an improved pivoting base merchandise hook in which the geometry of the hook and base is such as to render the hook substantially self-locking against accidental dislodgement. By advantageous positioning of the pivot axis of the base member in relation to the mounting lugs of the base, in conjunction with proper positioning of the hinge bar on the wire member, upward force tilting applied to the wire merchandise support is effectively prevented from causing a release motion of the pivoting base member.

For a more complete understanding of the above and other features and advantages of the invention, reference should be made to the following detailed description of a preferred embodiment and to the accompanying drawings.

DESCRIPTION OF PREFERRED EMBODIMENT

Figure 1:
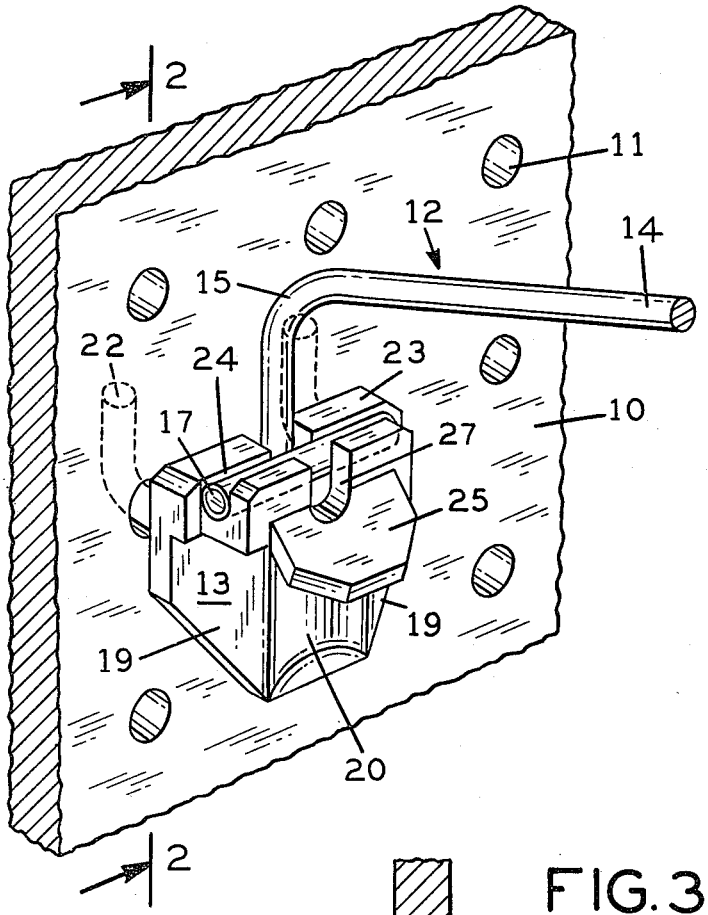
FIG. 1 is a front perspective view of the new merchandise hook of the invention, showing the wire merchandise support and the plastic base in assembled, installed, condition.

Referring now to the drawing, the reference numeral 10 designation generally a typical perforated panel display board provided with a large plurality of uniformly spaced openings 11 for the reception of hook-mounting lugs. The merchandise hook of the invention consists of two basic components, a wire element 12 and a base element 13. These two components are separately manufactured and, typically, are assembled by the customer to provide a working device.

The wire element 12 of the new hook assembly may be produced on high speed wire forming equipment and includes a generally straight, typically upwardly inclined merchandise supporting section 14. The outer end of the wire element is not illustrated, but may have any desired configuration, such as ball end, so-called "safety bend" or other desired configuration. At its inner end, the wire element 12 has a radius bend 15 from which extends downwardly a stabilizing leg 16. A short hinge bar 17 is welded to the front face of the stabilizing leg 16, well below the radius bend 15, and also well above the lower extremity 18 of the stabilizing leg.

It is contemplated that the welded-on hinge bar 17 will be joined with the main section of the wire element 12 as part of the high speed wire forming operations. By way of example only, it is contemplated that the hinge bar may be welded to the main wire section as part of a continuous sequence of operations, to be followed by cutting to length and bending to shape of the wire section. The axis of the hinge bar is controlled to be perpindicular to the axis of the stabilizing leg 16 and also perpendicular to the plane containing the leg 16 and the outwardly extending merchandise supporting section 14.

The base member 13, pursuant to the invention, is a molded plastic part, of a suitable engineering plastic material, such as, for example, that marketed by DuPont under the trademark "Delrin". Other plastic materials may, of course, be utilized, provided they have adequate strength and stability and are available at favorable cost levels.

Figure 4:
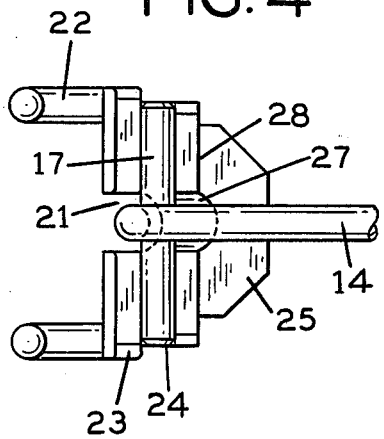
FIGS. 4 and 5 are top and bottom plan views respectively of the new hook, showing details of construction of the molded plastic base member.
Figure 5:
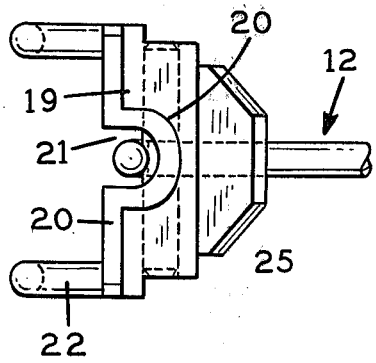

In the illustrated form of the invention, the plastic base member 13 includes a pair of generally flat side panels 19 joined by a vertically extending rib-like central section 20. Each of the side panels mounts a rearwardly extending, L-shaped mounting lug 22, which may be of conventional configuration and dimensions adapted for reception in an adjacent pair of panel board openings 11 in a well-known manner. The rib-like central section 20 is formed with a rearwardly opening, vertically extending recess 21 (see FIGS. 4 and 5) of sufficient depth to fully receive the stabilizing portion 16 of the wire member. Where desired, as in the illustrated device, the recess 21 may be sufficiently large to receive wire members of different sizes.

Extending horizontally across the top of the plastic base member 13 is a forwardly extending top flange 23 provided with a horizontal upwardly opening hinge recess 24 for reception of the hinge bar 17. To particular advantage, the upwardly opening recess 24 has a cross-section configuration which is generally cylindrical in the lower portion, having a width (front to back) dimension of the top which is somewhat smaller than the diameter of the hinge bar 17. Accordingly, insertion of the hinge bar 17 into the recess invovles the application of some pressure to deflect the plastic material on opposite sides of the recess opening in order to accommodate entry of the hinge bar. Once the hinge bar has been fully seated in the recess, it is semi-permanently retained therein, so that the two primary components will remain in an assembled relation unless and until intentionally separated. In practice, this likely will not occur, because of the unique functional aspects of the device.

Figure 3:
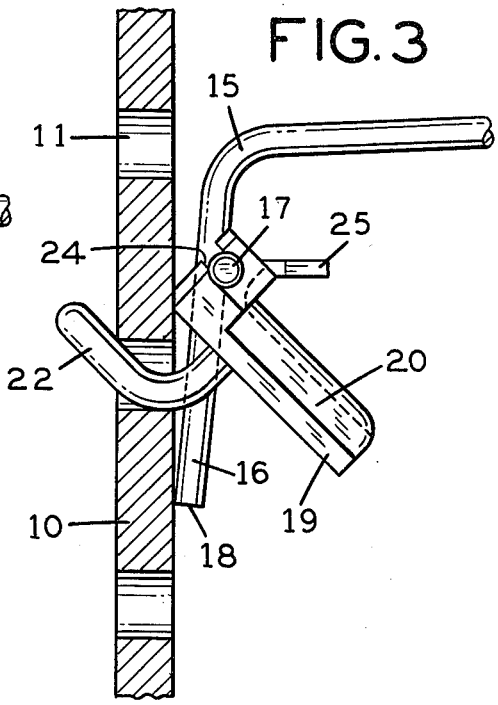
FIG. 3 is a cross-sectional view of a similar to FIG. 2, illustrating the hook with its base member pivoted upwardly, in a position for effecting removal and/or installation.

When the wire and base member 12,13 are assembled by insertion of the hinge bar 17 into the base recess 24, the assembled unit provides the important functional advantages of the Thalenfeld U.S. Pat. No. 3,289,993. That is, for insertion and removal of the hook from the panel board 10, the plastic base member may be pivoted on the hinge bar 17, by lifting the lower portion of the base member outward and upward with respect to the panel board 10. In FIG. 3, the base member 13 is shown in a partially upwardly pivoted position. Upon continuing upward movement of the base, until the base is generally at right angles to the main panel board 10, the lugs 22 become generally aligned with the panel board apertures 11, allowing the display hook to be either removed or inserted by a generally horizontal movement toward or away from the panel board 10. To facilitate such upward pivoting movement, the plastic base member 13 advantageously is provided with an integral outwardly and downwardly extending finger-engageable flange 25. By merely placing a thumb of finger under the flange 25 and pressing upwardly, the base member 13 is easily pivoted to its install/remove position, as will be appreciated.

Figure 2:
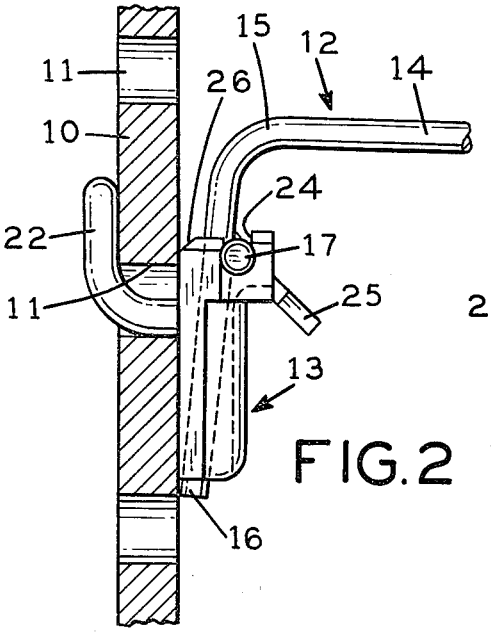
FIG. 2 is a cross-sectional view as taken generally on line 2—2 of FIG. 1, illustrating the hook in its normal condition, mounted on a perforated display panel.

As reflected in particularly FIGS. 2 and 3, the upper rearward corner area of the top flange 23 is rounded or beveled, as at 26, to avoid undesirable interference with the front surface of the panel 10 during upward pivoting movement of the base member. Similarly, the outwardly extending flange 23 is provided with an upwardly opening, forwardly extending recess 27, which receives the stabilizing portion 16 of the wire, when the base member is pivoted upwardly.

Figure 6:
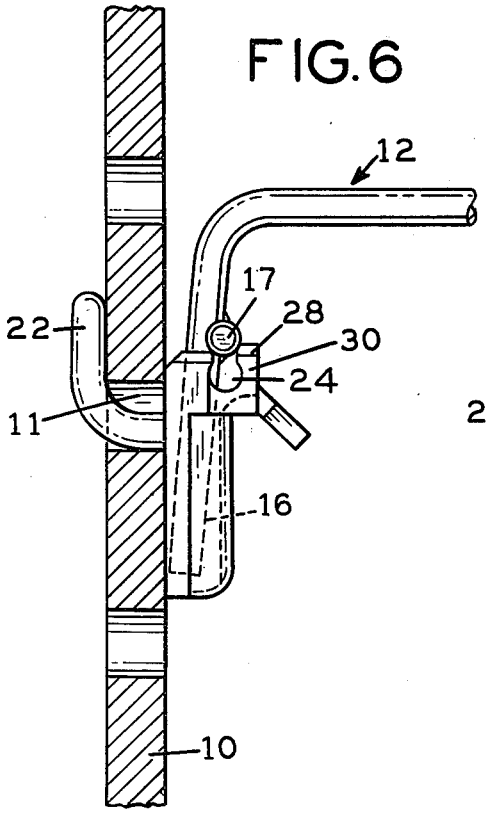
FIGS. 6 and 7 are cross-sectional views, similar to FIGS. 2 and 3, illustrating a simple procedure for effecting initial assembly of the wire merchandise support to the plastic base member.
Figure 7:
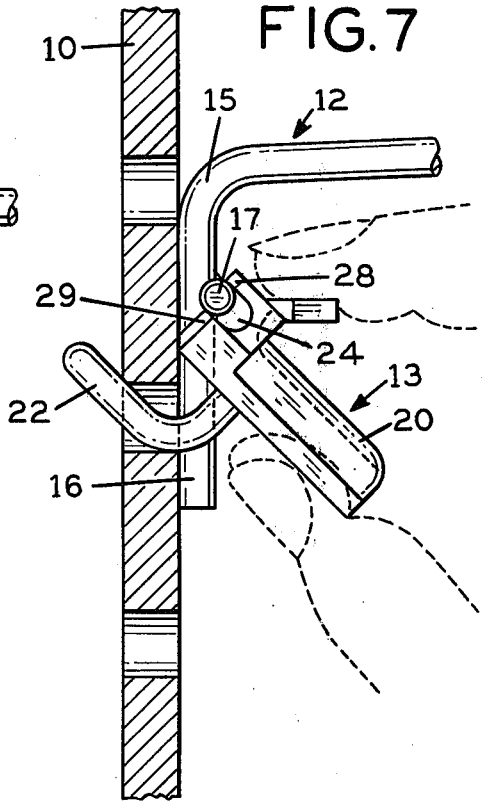

As a subsidiary but advantageous feature of the invention, the plastic base member 13 has been given a configuration to simplify and facilitate the initial assembly of the wire member 12 to the plastic base 13. To this end, the recess 24, which receives the hinge bar 17, is provided with an upwardly projecting forward lip 28, which is slightly higher than the flange portions 29 forming the rear wall of the recess 24. Easy assembly of the two components is carried out following the procedure shown in FIGS. 6 and 7. First, the plastic base member 13, by itself, is mounted on the panel 10 by inserting the lugs 22 into an appropriate pair of panel apertures 11. The wire member 12 is then brought into position by assembly by inserting the stabilizing portion 16 downwardly into the vertical recess 22 until the hinge bar 17 comes to rest in the upwardly opening hinge recess 24 (FIG. 6). As is to be understood, since the top portion 30 of that recess is narrower than the diameter of the hinge bar 17, the hinge bar will not fully enter the recess without the application of a certain amount of force. With the device of the invention, this force is easily and conveniently applied by causing the plastic member 13 to be tilted upwardly, as shown in FIG. 7. Thus, the upwardly projecting forward lip 28 effectively confines the hinge bar 17 during the initial upward tilting movements of the plastic base, and causes the stabilizing portion 16 of the hook to be pressed against the front surface of the panel board 10. As the plastic base is tilted forward and upward, the base itself is held in toward the panel board by the L-shaped mounting lugs 22. As a result, continued tilting movement of the base causes the recess 24 to be forcibly applied over the hinge bar 17 until it snaps into its fully assembled position. This is accomplished with a simple, rapid, upwardly tilting of the base, and may be carried out with one hand. Of course, it is also possible to assemble the two parts in a more conventional way by merely placing the hinge bar in the upper portion of the hinge groove 24 and pressing the two parts forcibly together until the hinge bar snaps into position within the recess 24.

Regardless of how the plastic base 13 is assembled to the wire member 12, the two parts are thereafter for all practical purposes permanently assembled, so that the customer is not thereafter required to handle the merchandise hook in two parts. More importantly still, after assembly of the two parts, the base member 13 has a pivoted association with the hook member and functions in all respects and has all the important advantages which are charactertic of all of the Thalenfeld U.S. Pat. No. 3,289,993.

In one of the more advantageous forms of the invention, substantial self-locking characteristics are incorporated into the hook design, so that it is extremely difficult, if not, impossible, for the hook to become accidentally dislodged from its mounted location. To this end, the hinge recess 24 is so located in the base member 13 as to support the hinge bar 17 at a level such that the asis the hinge bar is near, or even more preferably above, the top of the panel opening 11 in which the lugs 22 are inserted. In addition to this, the hinge bar 17 is spaced substantially below the portions of the wire hook 12 which contact the front of the panel when the hook is tilted upwardly. This geometric relationship effectively prevents accidental dislodgement of the hook by reason of upward tilting force applied to the wire section 14. When this occurs, the wire contacts the front surface of the panel board 10, in the region of the radius bend 15, which is well above the level of the hinge bar 17. The direction of outward force upon the hinge bar is thus nearly horizontal and, being applied at a level near the upper portion of the panel apertures 11, does not exhibit a tendency to pivot the base element in an upward or release direction.

The merchandise hook of the present invention represents a very significant advance in the art, in that it enables all of the functional superiority of the patented Thalenfeld hook to be realized in a device which has the cost advantages of a conventional, but functionally inferior two-part plastic base hook. In other words, both the primary metal hook member and the plastic base member may be manufactured on high speed, mass production equipment at extremely low unit cost, and since assembly of the base member to the wire member is typically to be carried out by the customer, such assembly does not form a component of the manufacturing cost of the device. For practical purposes, the manufacturing cost of the new, functionally superior hook differs insignificantly from the cost of the device of, for example, the Silver U.S. Pat. No. 3,897,926, which lacks the important functional features of the pivoted base hook design.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A two part merchandise hook or the like which comprises (a) a formed wire support element having an outwardly extending portion and a downwardly extending stabilizing portion, (b) a hinge bar secured to said support element;

(c) a molded plastic base member including spaced, L-shaped mounting lugs adapted for reception in an apertured display panel, (d) said base member having an open-sided hinge recess for the reception of said hinge bar, (e) said base member being pivotable about said hinge bar when assembled therewith, (f) the open side of said recess being of smaller dimension than the diameter of said hinge bar, whereby said hinge bar is forceably inserted into said recess and is self-retaining therein after assembly.

2. A merchandise hook according to claim 1, further characterized by (a) said base member having a rearwardly opening, vertically extending recess for reception of the stabilizing portion of said hook, (b) said hinge recess being positioned horizontally in said base member in front of said vertically extending recess.

3. A merchandise hook according to claim 2, further characterized by (a) said hinge recess being generally upwardly opening and (b) the front side of said recess being defined in part by an upwardly projecting guide lip engageable with the hinge bar of said support element during insertion of said hinge bar into said recess.

4. A merchandise hook according to claim 1, further characterized in that (a) said hinge recess being so located that the axis of said hinge bar is above the level of the panel apertures in which said mounting lugs are received when said hook is installed on an apertured display panel.

5. A merchandise hook according to claims 1 or 4, further characterized by (a) the stabilizing portion of said support element extending upwardly a substantial distance above said hinge bar such that, upon upward tilting movement of a panel board mounted support element said element engages said panel board at a location substantially above said hinge bar.

6. A two-part merchandising display element or the like for mounting on an apertured display panel, which comprises (a) a display element to be mounted, including a generally vertical stablizing section, (b) a horizontal hinge bar secured to said display element, (c) a pre-formed base member having a pair of spaced, L-shaped mounting lugs integral therewith and including an open sided hinge recess for the reception of said hinge bar, (d) said hinge recess including resiliently deformable side wall portions defining an opening narrower than the diameter of said hinge bar and being deflectable laterally to accommodate insertion and/or removal of said hinge bar.

7. A merchandising hook according to claim 6, further characterized by (a) said hinge recess being generally upwardly opening or inwardly opening, (b) said hinge bar being supportable in the open side of said recess when said base member is in an installed position or an apertured display panel, and (c) said recess side wall portions being deformable by upward pivoting movement of said base member to effect seating of said hinge bar in said hinge recess.

8. A merchandise hook according to claim 6, further characterized by (a) said base member being a one-piece molding of plastic material.

9. A merchandise hook according to claim 6, further characterized by (a) said stabilizing portion extenting substantially above said hinge bar, and (b) said hinge bar being located by said hinge recess at a level above the panel openings in which said L-shaped mounting lugs are received.

10. In a two-part display hook assembly or the like of the type adapted for mounting on a display panel, (a) a merchandise support element provided with a generally vertically extending stabilizing portion, (b) horizontal hinge bar means secured to said stabilizing portion, (c) a base member pivoted on said hinge bar means and having rearwardly projecting L-shaped mounting lugs for mounting said base member to an apertured display panel, (d) hinge bar receiving recess means in said base member, (e) said recess means locating the axis of said hinge bar means at a level above the top of the panel apertures in which said mounting lugs are received, (f) said stabilizing portion including a portion extending upward above said hinge bar means in close proximity to the front of said panel, (g) said merchandise support element comprising a wire-like element, (h) said stabilizing element being integral with and forming a downward extension of said wire-like element, (i) said hinge bar means comprising a horizontally disposed wire-like section welded to the front of said stabilizing element at a location spaced below the contact point between said support element and/or stabilizing element and said display panel, (j) said base member having a portion extending downward from said hinge bar means and having a vertically extending rearwardly opening recess for receiving lower portions of said stabilizing element, (k) said base member being of molded plastic material and having a resilient snap-fit relation with said hinge bar means.

* * * * *